US011248389B2

(12) United States Patent
Fu et al.

(10) Patent No.: US 11,248,389 B2
(45) Date of Patent: Feb. 15, 2022

(54) INERTIAL MASS AMPLIFICATION TYPE TUNED MASS DAMPER

(71) Applicant: DALIAN UNIVERSITY OF TECHNOLOGY, Liaoning (CN)

(72) Inventors: Xing Fu, Liaoning (CN); Hongnan Li, Liaoning (CN); Gang Li, Liaoning (CN); Yao Jiang, Liaoning (CN); Wenlong Du, Liaoning (CN); Zhiqian Dong, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 38 days.

(21) Appl. No.: 16/967,683

(22) PCT Filed: Sep. 20, 2019

(86) PCT No.: PCT/CN2019/106888
§ 371 (c)(1),
(2) Date: Aug. 5, 2020

(87) PCT Pub. No.: WO2021/051373
PCT Pub. Date: Mar. 25, 2021

(65) Prior Publication Data

US 2021/0087841 A1 Mar. 25, 2021

(51) Int. Cl.
*E04H 9/02* (2006.01)
*E04B 1/98* (2006.01)

(52) U.S. Cl.
CPC ..... *E04H 9/0215* (2020.05); *E04B 1/98* (2013.01); *E04H 9/023* (2013.01)

(58) Field of Classification Search
CPC ..... E04H 9/0215; E04H 9/027; E04H 9/023; E04H 9/029; E04B 1/985; F16F 7/1022; F16F 7/00
USPC ..... 52/167.9, 167.5, 167.4, 167.1, 167.8; 248/560, 562, 563, 566, 568; 384/36, 384/44–46, 99, 101, 491–492, 513, 565, 384/261; 188/381, 378, 379, 380; 267/205, 41, 182
See application file for complete search history.

(56) References Cited

FOREIGN PATENT DOCUMENTS

CN 204435592 U 7/2015
CN 106758765 A 5/2017
(Continued)

*Primary Examiner* — Babajide A Demuren
(74) *Attorney, Agent, or Firm* — Muncy, Geissler, Olds & Lowe, P.C.

(57) ABSTRACT

An inertial mass amplification type tuned mass damper is disclosed. The inertial mass amplification type tuned mass damper comprises a hollow box, an H-shaped mass block, gears a, gears b, a rectangular frame, a steel ring, viscous dampers, a steel sheet, springs, rotating shafts and balls. In the present invention, an inertial damping force is amplified by adjusting the radius ratio of the gears a and the gears b; and damping parameters can be conveniently changed by adjusting the mass of the mass block, the spring stiffness and the like. The present invention has the advantages that the design mass is small, which can avoid the adverse effects of excessive additional gravity on the structure and improve the performance of the structure. The present invention has reasonable design and small occupied space, can save more use area for buildings and can greatly improve the utilization efficiency of the buildings.

5 Claims, 1 Drawing Sheet

(56) References Cited

FOREIGN PATENT DOCUMENTS

| | | | | |
|---|---|---|---|---|
| CN | 107419945 | A | 12/2017 | |
| CN | 208830511 | U | 5/2019 | |
| KR | 10-2014-0011821 | A | 1/2014 | |
| WO | WO-2020177045 | A1 * | 9/2020 | ..... F16F 15/035 |

* cited by examiner

INERTIAL MASS AMPLIFICATION TYPE TUNED MASS DAMPER

TECHNICAL FIELD

The present invention belongs to the technical field of structural vibration control, and particularly relates to an inertial mass amplification type tuned mass damper.

BACKGROUND

With the continuous development of economy and society of China, the construction of super-high-rise buildings, transmission towers and other high flexible structures is rapidly developed in China, and will play an important role in social and economic development for a long time. In China, as a disaster-prone country, the design of disaster prevention and mitigation, such as earthquake resistance and wind resistance, for the building structure has always been the focus of the attention. Ensuring the safety and comfort of these structures under the action of earthquakes and strong wind has become a key problem that needs to be urgently solved. As a widely used passive control damper, a tuned mass damper is widely applied in the field of structural vibration control. However, in actual engineering, to achieve a predetermined vibration reduction objective, the mass of the tuned damper needs to be designed to be very large, and generally needs to exceed the weight of the structure by 1%. However, due to the limitation of an installation space, the mass of the damper cannot be designed to be very large, which makes it difficult to achieve the predetermined vibration reduction objective. At the same time, for the high flexible structures, excessive additional mass may adversely affect the structure. The innovation of the present invention is the reduction of the mass of the damper. The damper can provide a large inertial damping force with small mass, thereby greatly improving the vibration reduction effect.

SUMMARY

In view of the problem that the mass of a damper is generally large in the prior art, the present invention proposes an inertial mass amplification type tuned mass damper with reasonable structure, small mass and good vibration reduction effect.

The present invention reduces the wind vibration and earthquake response of a high flexible structure, and improves the wind and earthquake resistance performance of the building.

To achieve the above purpose, the present invention adopts the following technical solution:

An inertial mass amplification type tuned mass damper is provided. The inertial mass amplification type tuned mass damper comprises a hollow box 1, an H-shaped mass block 2, gears a 3, gears b 4, a rectangular fame 5, a steel ring 6, viscous dampers 7, a steel sheet 8, springs 9, rotating shafts 10 and balls 11.

The hollow box 1 is installed between two walls; a plurality of balls 11 are installed on the bottom of the H-shaped mass block 2; tooth slots are formed on both sides of a web plate of the H-shaped mass block 2; the H-shaped mass block 2 is put into the hollow box 1; the H-shaped mass block 2 can slide inside the hollow box 1; the sliding direction of the H-shaped mass block 2 is parallel to a vertical connecting line between installing surfaces of the hollow box 1; two parallel outer side edges of the rectangular frame 5 are provided with tooth slots, and the other two parallel outer side edges are provided with rectangular through holes; one outer side edge with the through hole in the rectangular frame 5 is provided with two springs 9, and the ends of the springs 9 are installed on an inner wall of the hollow box 1 through the steel ring 6; the other outer side edge with the through hole in the rectangular frame 5 is provided with two viscous dampers 7, and the ends of the viscous dampers 7 are installed on the inner wall of the hollow box 1 through the steel ring 6; the two springs 9 and the two viscous dampers 7 are parallel to each other, and parallel to the vertical connecting line between the two walls; the steel sheet 8 is horizontally installed on the inner wall of the hollow box 1 through the through hole of the rectangular frame 5; the balls are installed on the steel sheet 8 for supporting the sliding of the rectangular fame 5; the sliding direction of the rectangular frame 5 is parallel to the vertical connecting line between the two walls; two gears a 3 are arranged and are respectively engaged with the two tooth slots on the web plate of the H-shaped mass block 2; two gears b 4 are arranged, which are respectively engaged with the tooth slots on both sides of the rectangular frame 5; the gears a 3 and the gears b 4 are installed on two rotating shafts 10 in pairs, and the gears a 3, the gears b 4 and the rotating shafts 10 are fixedly connected to realize synchronous rotation; and each of the rotating shafts 10 is vertically installed in the hollow box 1 through a bearing.

Further, the radius of the gears a 3 is larger than the radius of the gears b 4; the magnification of an inertial damping Force is adjusted by adjusting the radius ratio of the gears a and the gears b; the larger the radius ratio is, the more obvious the vibration reduction effect is.

Further, the hollow box 1, the H-shaped mass block 2, the gears a 3, the gears b 4, the rectangular frame 5, the steel ring 6, the steel sheet 8, the springs 9, the rotating shafts 10 and the balls 11 are made of stainless steel.

Further, the section of the steel sheet 8 is processed into a "concave" shape to improve the bending stiffness.

Further, the present invention can change damping parameters by adjusting the stiffness of the springs 9.

Further, the present invention can change the damping parameters by adjusting the mass of the H-shaped mass block 2.

The present invention has the working principle that:

When the wall structure vibrates, the hollow box 1 vibrates synchronously with the structure, and the H-shaped mass block 2 has displacement hysteresis due to the action of inertia. The hollow box 1 and the H-shaped mass block 2 generate relative movement, thereby causing the gears a 3 and the gears b 4 to rotate. Two gears drive the rectangular frame 5, the springs 9 and the viscous dampers 7 to move, and apply a force opposite to the movement direction to the hollow box 1. The kinetic energy of the H-shaped mass block 2 is dissipated by the viscous dampers 7 and reset under the action of the springs 9.

The mass of the mass block is set as $m_0$; a viscous damping coefficient is $c_0$; the spring stiffness is $k_0$; an external load is $p_0(t)$; and the displacement of the mass block is x. Thus, a dynamic equation is:

$$m_0\ddot{x}+c_0\dot{x}+k_0x=p_0(t) \tag{1}$$

For the inertial mass amplification type tuned mass damper of the present invention, the H-shaped mass block is $m_1$;

$$m_1 = \frac{m_0}{\lambda}$$

(wherein $$\lambda = \frac{R}{r};$$

R is the radius of the gears a; r is the radius of the gears b; and R>r); and the displacement generated under the action of the external load $p_1(t)$ is $x_1$. When the displacement of the H-shaped mass block is $x_1$, the rotating arc length of the gears a is set as $l_1$ and the rotating arc length of the gears b is set as $l_2$. Thus, $l_1=x_1$. The gears a and the gears b are fixedly connected, so that a rotating angle is the same, and an arc length formula is used to obtain:

$$\frac{l_1}{R} = \frac{l_2}{r} \tag{2}$$

Thus, the rotating arc length of the gears b is $$l_2 = \frac{r}{R} l_1 = \frac{x_1}{\lambda}.$$

Because the rectangular frame is engaged with the gears b, the sliding displacement of the rectangular frame is $$\frac{x_1}{\lambda}.$$

For the elastic restoring force and the damping force, through gear devices, it can be seen from a functional principle that the magnification is λ, so that the dynamic equation is:

$$\lambda m_1 \ddot{x}_1 + c_1 \frac{\dot{x}_1}{\lambda} + k_1 \frac{x_1}{\lambda} = p_1(t) \tag{3}$$

For a general tuned mass damper, frequency is $$\omega_0 = \sqrt{\frac{k_0}{m_0}}.$$

For the inertial mass amplification type tuned mass damper of the present invention, if $k_1=\lambda k_0$, then frequency is $$\omega_1 = \sqrt{\frac{k_1/\lambda^2}{m_1}} = \sqrt{\frac{\lambda k_0}{\lambda^2 m_0/\lambda}} = \sqrt{\frac{k_0}{m_0}} = \omega_0.$$

The frequencies are equal. Meanwhile, when the movement states of the mass blocks of the two dampers are consistent, i.e., $x_0=x_1$, $\dot{x}_0=\dot{x}_1$, $\ddot{x}_0=\ddot{x}_1$, and a damping ratio is $c_1=\lambda c_0$, then a reaction force on the structure is $P_0(t)=P_1(t)$. Therefore, when the same vibration reduction effect is achieved, the mass of the present invention is only $$\frac{1}{\lambda}$$

of the mass of the general tuned mass damper, and the size of λ depends on the radius ratio of the gears a and the gears b.

The present invention has the following beneficial effects:

(1) In the inertial mass amplification type tuned mass damper of the present invention, the inertial damping force is amplified by adjusting the radius ratio of the gears a and the gears b; a good vibration reduction effect can be achieved by small mass; the larger the radius ratio is, the more obvious the vibration reduction effect is.

(2) In the inertial mass amplification type tuned mass damper of the present invention, the damping parameters can be conveniently changed by adjusting the mass of the mass block, the radius ratio of the gears a and the gears b and the spring stiffness.

(3) In the inertial mass amplification type tuned mass damper of the present invention, the design mass is small, which can avoid the adverse effects of excessive additional gravity on the structure and improve the performance of the structure.

(4) In the inertial mass amplification type tuned mass damper of the present invention, the occupied space is small, which can save more use area for the building and greatly improve the utilization efficiency of the building.

(5) The inertial mass amplification type tuned mass damper of the present invention has reasonable design, simple structure and convenient installation.

In the figures: 1 hollow box; 2 H-shaped mass block; 3 gear a; 4 gear b; 5 rectangular frame; 6 steel ring; 7 viscous damper; 8 steel sheet; 9 spring; 10 rotating shaft; and 11 ball.

DETAILED DESCRIPTION

In order to make the purpose, features, and advantages of the present invention more obvious and understandable, the present invention is further described below with reference to the drawings and in conjunction with specific embodiments, so that those skilled in the art can implement the present invention with reference to the words of the description. The protection scope of the present invention is not limited to the detailed description. Apparently, the embodiments described below are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
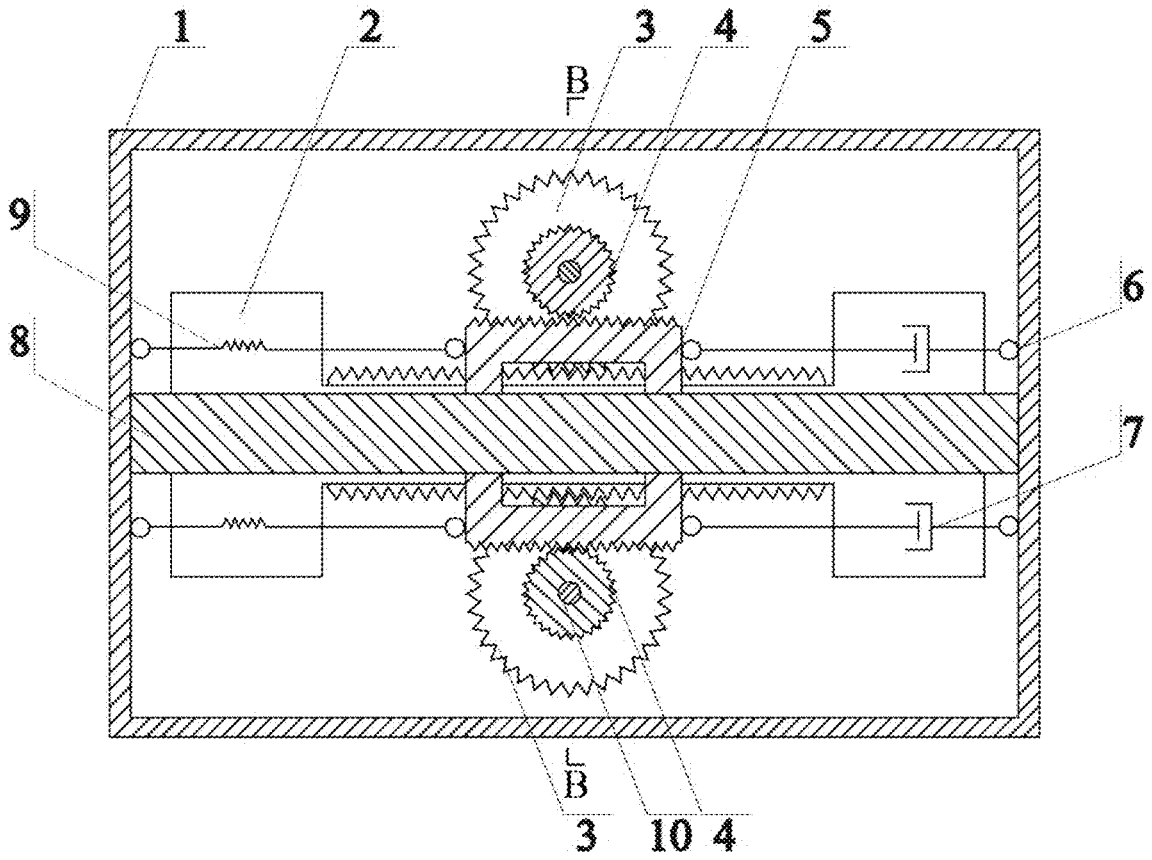
FIG. 1 is an A-A sectional view of an inertial mass amplification type tuned mass damper provided in embodiments of the present invention.
Figure 2:
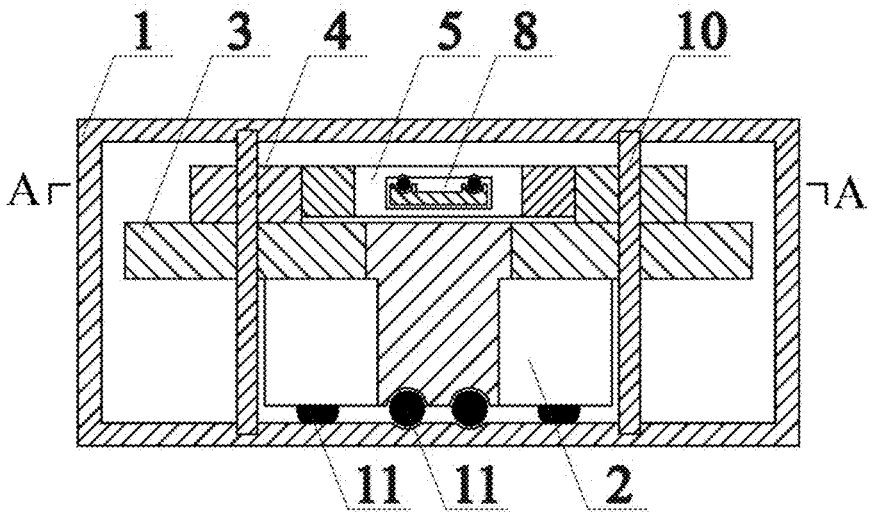
FIG. 2 is a B-B sectional view of an inertial mass amplification type tuned mass damper provided in embodiments of the present invention.

An inertial mass amplification type tuned mass damper is provided as shown in FIG. 1 and FIG. 2. The inertial mass amplification type tuned mass damper comprises a hollow box 1, an H-shaped mass block 2, gears a 3, gears b 4, a rectangular frame 5, a steel ring 6, viscous dampers 7, a steel sheet 8, springs 9, rotating shafts 10 and balls 11.

The hollow box 1 is installed between two walls; a plurality of balls 11 are installed on the bottom of the H-shaped mass block 2; tooth slots are formed on both sides of a web plate of the H-shaped mass block 2; the H-shaped mass block 2 is put into the hollow box 1; the H-shaped mass block 2 can slide inside the hollow box 1; the sliding direction of the H-shaped mass block 2 is parallel to a vertical connecting line between two walls; two parallel outer side edges of the rectangular frame 5 are provided with tooth slots, and the other two parallel outer side edges are provided with rectangular through holes; one outer side edge with the through hole in the rectangular frame 5 is provided with two springs 9, and the ends of the springs 9 are installed on an inner wall of the hollow box 1 through the steel ring 6; the other outer side edge with the through hole in the rectangular frame 5 is provided with two viscous dampers 7, and the ends of the viscous dampers 7 are installed on the inner wall of the hollow box 1 through the steel ring 6; the two springs 9 and the two viscous dampers 7 are parallel to each other, and parallel to the vertical connecting line between the two walls; the steel sheet 8 is horizontally installed on the inner wall of the hollow box 1 through the through hole of the rectangular frame 5; the balls are installed on the steel sheet 8 for supporting the sliding of the rectangular frame 5; the sliding direction of the rectangular frame 5 is parallel to the vertical connecting line between the two walls; two gears a 3 are arranged and are respectively engaged with the two tooth slots on the web plate of the H-shaped mass block 2; two gears b 4 are arranged and are respectively engaged with the tooth slots on both sides of the rectangular frame 5; the gears a 3 and the gears b 4 are installed on two rotating shafts 10 in pairs, and the gears a 3, the gears b 4 and the rotating shafts 10 are fixedly connected to realize synchronous rotation; and each of the rotating shafts 10 is installed on the inner wall of the hollow box 1.

Further, the radius of the gears a 3 is larger than the radius of the gears b 4.

Further, the hollow box 1, the H-shaped mass block 2, the gears a 3, the gears b 4, the rectangular frame 5, the steel ring 6, the steel sheet 8, the springs 9, the rotating shafts 10 and the balls 11 are made of stainless steel.

Further, the section of the steel sheet 8 is processed into a "concave" shape to improve the bending stiffness.

Further, the present invention can change damping parameters by adjusting the stiffness of the springs 9.

Further, the present invention can change the damping parameters by adjusting the mass of the H-shaped mass block 2.

The present invention has the working principle that:

When the wall structure vibrates, the hollow box 1 vibrates synchronously with the structure, and the H-shaped mass block 2 has displacement hysteresis due to the action of inertia. The hollow box 1 and the H-shaped mass block 2 generate relative movement, thereby causing the gears a 3 and the gears b 4 to rotate. Two gears drive the rectangular frame 5, the springs 9 and the viscous dampers 7 to move, and apply a force opposite to the movement direction to the hollow box 1. The kinetic energy of the H-shaped mass block 2 is dissipated by the viscous dampers 7 and reset under the action of the springs 9.

The mass of the mass block is set as $m_0$; a viscous damping coefficient is $c_0$; the spring stiffness is $k_0$; an external load is $p_0(t)$; and the displacement of the mass block is x. Thus, a dynamic equation is:

$$m_0\ddot{x}+c_0\dot{x}+k_0x=p_0(t) \tag{1}$$

For the inertial mass amplification type tuned mass damper of the present invention, the H-shaped mass block is $m_1$;

$$m_1 = \frac{m_0}{\lambda}$$

(wherein $$\lambda = \frac{R}{r};$$

R is the radius of the gears a; r is the radius of the gears b; and R>r); and the displacement generated under the action of the external load $p_1(t)$ is $x_1$. When the displacement of the H-shaped mass block is $x_1$, the rotating arc length of the gears a is set as $l_1$ and the rotating arc length of the gears b is set as $l_2$. Thus, $l_1=x_1$. The gears a and the gears b are fixedly connected, so that a rotating angle is the same, and an arc length formula is used to obtain:

$$\frac{l_1}{R} = \frac{l_2}{r} \tag{2}$$

Thus, the rotating arc length of the gears b is $$l_2 = \frac{r}{R}l_1 = \frac{x_1}{\lambda}.$$

Because the rectangular frame is engaged with the gears b, the sliding displacement of the rectangular frame is $$\frac{x_1}{\lambda}.$$

For the elastic restoring force and the damping force, through gear devices, it can be seen from a functional principle that the magnification is λ, so that the dynamic equation is:

$$\lambda m_1\ddot{x}_1 + c_1\frac{\dot{x}_1}{\lambda} + k_1\frac{x_1}{\lambda} = p_1(t) \tag{3}$$

For a general tuned mass damper, frequency is $$\omega_0 = \sqrt{\frac{k_0}{m_0}}.$$

For the inertial mass amplification type tuned mass damper of the present invention, if $k_1=\lambda k_0$, then frequency is $$\omega_1 = \sqrt{\frac{k_1/\lambda^2}{m_1}} = \sqrt{\frac{\lambda k_0}{\lambda^2 m_0/\lambda}} = \sqrt{\frac{k_0}{m_0}} = \omega_0.$$

The frequencies are equal. Meanwhile, when the movement states of the mass blocks of the two dampers are consistent, i.e., $x_0=x_1$, $\dot{x}_0=\dot{x}_1$, $\ddot{x}_0=\ddot{x}_1$ and a damping ratio is $c_1=\lambda c_0$, then a reaction force on the structure is $P_0(t)=P_1(t)$. Therefore, when the same vibration reduction effect is achieved, the mass of the present invention is only $$\frac{1}{\lambda}$$

of the mass of the general tuned mass damper, and the size of $\lambda$ depends on the radius ratio of the gears a and the gears b.

In the inertial mass amplification type tuned mass damper of the present invention, the inertial damping force is amplified by adjusting the radius ratio of the gears a and the gears b; a good vibration reduction effect can be achieved by small mass; the larger the radius ratio is, the more obvious the vibration reduction effect is.

In the inertial mass amplification type tuned mass damper of the present invention, the damping parameters can be conveniently changed by adjusting the mass of the mass block, the radius ratio of the gears a and the gears b and the spring stiffness.

In the inertial mass amplification type tuned mass damper of the present invention, the design mass is small, which can avoid the adverse effects of excessive additional gravity on the structure and improve the performance of the structure.

In the inertial mass amplification type tuned mass damper of the present invention, the occupied space is small, which can save more use area for the building and greatly improve the utilization efficiency of the building.

The inertial mass amplification type tuned mass damper of the present invention has reasonable design, simple structure and convenient installation.

The invention claimed is:

1. An inertial mass amplification type tuned mass damper, comprising a hollow box, an H-shaped mass block, first gears, second gears, a rectangular frame, a steel ring, viscous dampers, a steel sheet, springs, rotating shafts and balls, wherein the hollow box is installed between two walls; the H-shaped mass block is placed inside the hollow box; a plurality of balls are installed on the bottom of the H-shaped mass block; the H-shaped mass block can slide inside the hollow box; the sliding direction of the H-shaped mass block is parallel to a vertical connecting line between installing surfaces of the hollow box; tooth slots are formed on both sides of a web plate of the H-shaped mass block;

two parallel outer side edges of the rectangular frame are provided with tooth slots, and the other two parallel outer side edges are provided with rectangular through holes; one outer side edge with the through hole in the rectangular frame is provided with two springs, and the ends of the springs are installed on an inner wall of the hollow box through the steel ring; the other outer side edge with the through hole in the rectangular frame is provided with two viscous dampers, and the ends of the viscous dampers are installed on the inner wall of the hollow box through the steel ring; the two springs and the two viscous dampers are parallel to each other, and parallel to the vertical connecting line between the two walls; the steel sheet is horizontally installed on the inner wall of the hollow box through the through hole of the rectangular frame; the balls are installed on the steel sheet for supporting the sliding of the rectangular frame; the sliding direction of the rectangular frame is parallel to the vertical connecting line between the two walls;

two first gears are arranged, which are respectively engaged with the two tooth slots on the web plate of the H-shaped mass block; two second gears are arranged and are respectively engaged with the tooth slots on both sides of the rectangular frame; the first gears and the second gears are installed on two rotating shafts in pairs, and the first gears, the second gears and the rotating shafts are fixedly connected to realize synchronous rotation; and each of the rotating shafts is vertically installed on the inner wall of the hollow box through a bearing.

2. The inertial mass amplification type tuned mass damper according to claim 1, wherein the radius of the first gears is larger than the radius of the second gears; the magnification of an inertial damping force is adjusted by adjusting the radius ratio of the first gears and the second gears; the larger the radius ratio is, the more the vibration reduction effect is.

3. The inertial mass amplification type tuned mass damper according to claim 1, wherein the hollow box, the H-shaped mass block, the first gears, the second gears, the rectangular frame, the steel ring, the steel sheet, the springs, the rotating shafts and the balls are made of stainless steel.

4. The inertial mass amplification type tuned mass damper according to claim 1, wherein a section of the steel sheet is in a concave shape.

5. The inertial mass amplification type tuned mass damper according to claim 3, wherein a section of the steel sheet is in a concave shape.

* * * * *